US005610645A

United States Patent [19]

Moore et al.

[11] Patent Number: 5,610,645

[45] **Date of Patent: *Mar. 11, 1997**

[54] INK JET HEAD WITH CHANNEL FILTER

[75] Inventors: John S. Moore, Beaverton; Sharon S. Berger, Salem; Ronald F. Burr, Tualatin, all of Oreg.; Jeffrey J. Anderson, Camas, Wash.; Donald B. MacLane, Portland, Oreg.

[73] Assignee: Tektronix, Inc., Wilsonville, Oreg.

[ * ] Notice: The term of this patent shall not extend beyond the expiration date of Pat. No. 5,489,930.

[21] Appl. No.: 56,227

[22] Filed: Apr. 30, 1993

[51] Int. Cl.[6] ..... B41J 2/175

[52] U.S. Cl. ..... 347/93; 210/498

[58] Field of Search ..... 346/75, 140 R; 210/500.1, 498, 488; 205/75, 122; 156/43, 644; 427/243, 244, 247; 222/189; 347/93, 94; 29/163.8; B41J 2/19

[56] References Cited

U.S. PATENT DOCUMENTS

| | | | |
|---|---|---|---|
| 3,606,973 | 9/1971 | Davis | 347/93 X |
| 4,046,359 | 9/1977 | Gellert | 210/488 X |
| 4,233,610 | 11/1980 | Fischbeck et al. | 347/94 |
| 4,379,304 | 4/1983 | Heinzl et al. | 347/68 X |
| 4,514,743 | 4/1985 | Roschlein et al. | 347/93 X |
| 4,639,748 | 1/1987 | Drake et al. | 347/67 |
| 4,680,595 | 7/1987 | Cruz-Uribe et al. | 347/40 |
| 4,864,329 | 9/1989 | Kneezel et al. | 346/140 R |
| 4,883,219 | 11/1989 | Anderson et al. | 347/71 X |
| 4,894,667 | 1/1990 | Moriyama | 347/93 X |
| 5,087,930 | 2/1992 | Roy et al. | 347/85 |
| 5,489,930 | 2/1996 | Anderson | 347/93 X |

FOREIGN PATENT DOCUMENTS 54-53832 4/1979 Japan .

OTHER PUBLICATIONS

Undated Extract of "Ink Jet Color Copier Model 4696" by Sharp Corporation, index and pp. 13 and 14.

*Primary Examiner*—Joseph W. Hartary
*Attorney, Agent, or Firm*—Ralph D'Alessandro

[57] ABSTRACT

A particulate filter (16) is provided within an inlet channel (22) of an ink jet (14). The filter is oriented generally in the direction of ink flow to provide a greater filter surface area. Positioning the filter within the inlet channel results in reduced acoustic crosstalk, more effective filtering, and more efficient purging of the filter itself because of the relatively high ink pressure drop across the filter in the channel. Positioning the channel vertically assists the buoyancy of the bubble movement during operation and purging.

11 Claims, 6 Drawing Sheets

12
14
16
16'
18
20
21
22
24
26
56a
56b
56'
70
70'
73
74
76
82
88
90
92
94

INK JET HEAD WITH CHANNEL FILTER

TECHNICAL FIELD

This invention relates to ink jet printers and in particular to an internal fluid filter in an ink jet print head.

BACKGROUND OF THE INVENTION

Ink jet systems, and in particular multi-orifice, drop-on-demand ink jet systems, are well known in the art. A multi-orifice, drop-on-demand ink jet print head receives ink from an ink supply and ejects drops of ink through multiple orifices onto a print medium. Both thermal-type ink jet heads, which eject a drop by heating the ink to form a bubble, and impulse-type ink jet heads, which eject a drop by compressing a chamber, are common.

A thermal-type drop-on-demand ink jet print head is typically constructed by bonding together silicon wafers or hybrid thin film circuit substrates, the wafers or substrates having appropriate circuitry and chambers formed on their surfaces. An impulse-type drop-on-demand ink jet print head is typically constructed by bonding together multiple plates, the various chambers and channels being formed by appropriate holes in individual plates.

A typical impulse-type of multi-orifice drop-on-demand ink jet print head has a body that defines plural ink pressure chambers which are generally planar in the sense that they are much larger in cross-section than in depth. The ink pressure chambers each have an ink inlet and an ink outlet. The ink jet print head includes an array of proximately located nozzles and passages for coupling the ink pressure chambers to the nozzles. Each ink pressure chamber is Coupled by an associated passage to an associated nozzle. A driver mechanism is used with each pressure chamber to displace the ink in the ink chamber. The driver mechanism typically consists of a bending-mode pressure transducer, i.e., a piezo-ceramic material ("PZT") sandwiched between thin metal films and bonded to a thin diaphragm. When a voltage is applied to the PZT, it attempts to change its planar dimensions, but because the PZT is securely and rigidly attached to the diaphragm, bending occurs. This bending displaces ink in the ink chamber, causing the flow of ink both through an inlet from the ink supply to the ink chamber and through an outlet and passageway to a nozzle. Piston-like and shear-mode pressure transducers are also used as driving mechanisms for some ink jet printers.

The inlet of each pressure chamber is connected via a passage to a common ink manifold that supplies ink to the several pressure chambers. A restrictor orifice is sometimes positioned between the pressure chamber and the ink manifold to reduce acoustic crosstalk between pressure chambers. The use of such a restrictor orifice is described in U.S. Pat. No. 4,680,595 to Cruz-Uribe et al. for an Impulse Ink Jet Print Head and Method for Making Same.

For high resolution printing, it is desirable that the nozzles have very small orifices and be closely spaced. Close spacing requires correspondingly small internal channels. One method of achieving close spacing is described in U.S. Pat. No. 5,087,930 to Roy et al. for a Drop-on-Demand Ink Jet Print Head, which is hereby incorporated by reference in its entirety. Such small. orifices and internal channels in multiple orifice ink jet print heads are susceptible to clogging from particulate contamination that may be inadvertently introduced into the interior of the print head during assembly. Particulate contamination comes from various sources, such as the chromate layer on the ink reservoir, O-rings, bits of loose stainless steel from the various layers of the jet, and the assembly room environment.

U.S. Pat. No. 4,639,748 to Drake et al. illustrates an attempt to solve the particulate contamination problem. The patent describes a thermal ink jet print head constructed from two silicon wafers bonded together and having an integral ink filter. The integral filter, positioned between an internal ink reservoir chamber and capillary-filled ink supply channels, is formed by anisotropically and isotropically etching channels having cross-sectional areas smaller than the cross-sectional area of the nozzles into the silicon wall between the reservoir chamber and the supply manifold. Such fabrication methods are usable only for components fabricated from single crystal materials because other materials cannot be anisotropically etched to create the required structures. Also, such a filter cannot trap contaminants inadvertently introduced downstream from the manifold during assembly of the print head.

Another ink filter for a thermal ink jet print head is described in U.S. Pat. No. 4,864,329 to Kneezel et al. The print head described by Kneezel et al. comprises two silicon wafers, one of which has ink channels and an ink manifold having a fill hole. A wafer-sized, flat membrane filter is bonded to a silicon wafer surface over the fill holes to filter the ink before it enters the internal manifold of the print head. If the print head is constructed in the "roofshooter" configuration, i.e., the nozzles are located on the top surface of a silicon wafer, the membrane filter is positioned between the two silicon wafers and bonded to both. Such a filter, being an additional layer in the print head, increases the thickness and cost of the print head. Also, such a filter must be very flat to prevent ink from seeping around the filter. Additionally, this type of a filter is relatively far from the nozzle and, therefore, cannot trap many contaminants inadvertently introduced during assembly of the print head.

A Jolt Model printer by Dataproducts Corp. of Woodland Hills, Calif. uses a filter between the manifold and the inlet to the jets. However, particulate contamination trapped downstream of the manifold during assembly of the print head in this design can still clog the nozzles.

Filters are desirable to trap particulate contamination in ink jet print heads before such particulate contamination can clog the orifices or nozzles in the print head. However, existing filters are normally too remote from the nozzle to trap some of the particulate contamination introduced into print heads during assembly. Further, the use of filters carries the concomitant disadvantage of tending to restrict the flow of ink, thereby causing undesirable pressure drops.

Another difficulty encountered when using a particulate filter within a print head is the tendency of the small pores within the filter to trap bubbles. Purging is used to minimize this problem by applying a pressure drop across the filter to flush trapped bubbles out of the filter area during the purging operation. Practically it can be difficult to flush bubbles out of the filter because the ink typically lacks sufficient velocity and pressure at the filter location to transport the bubbles through the filter.

SUMMARY OF THE INVENTION

It is an object of the present invention to improve print quality in an ink jet print head by providing a particulate filter to prevent contaminants from clogging passages and orifices within the print head.

It is another object of the present invention to provide such a filter that can be readily purged of bubbles.

It is a further object of the present invention to reduce crosstalk between nozzles by providing a separate filter for each nozzle.

It is a feature of the present invention that a filter integral to a print head is provided to capture contamination introduced into the print head during manufacturing and assembly of the print head.

It is an advantage of the present invention to provide a filter within the inlet channel of the print head that does not unduly restrict the flow of ink or cause an unacceptable pressure drop.

In a multiple jet print head, ink typically flows from a common manifold to the pressure chamber of each jet through an inlet channel. According to the present invention, a filter is typically disposed in the interior of the inlet channel and aligned generally with the flow of ink. In a print head having a laminated construction, the filter is typically formed from a plate similar to the plate defining the inlet channel, but having filter pores in areas corresponding to the inlet channels. Each filter pore has a diameter somewhat smaller than that of the nozzle. The opposing major surfaces of the filter are aligned generally along the direction of ink flow through the inlet channel, i.e., a line normal to the major surfaces of the filter is more nearly orthogonal than parallel to the general direction of ink flow.

There are several advantages to positioning filters in the interior of the inlet channels. Because each nozzle typically has a separate inlet channel and filter, an individual nozzle is not significantly affected by pressure drops across filters of other nozzles, thus reducing crosstalk. The filter also potentially reduces crosstalk by acting as an acoustic wave filter, partly damping the pressure wave travelling back to the manifold from the driver. Bubbles are more readily purged from a filter in the inlet channel than from a filter in, for example, the manifold or manifold inlet because the pressure drop is higher across a filter in the inlet channel and the ink velocity is higher in the inlet channel. Also, a filter in the interior of the inlet channel, as compared to one in the manifold or at the entrance of the inlet channel, is closer to the nozzle, thereby increasing the probability of filtering any particulate trapped within the print head during assembly.

Aligning the filter with the major surfaces generally along the ink flow direction, rather than transverse to the ink flow direction, provides a larger filter surface area which provides for a larger number of filter pores. Thus, because the total pore area, i.e., the combined cross-sectional area of all of the pores, is relatively large, ink flows through the inlet channel with an acceptably small pressure drop. Furthermore, because of the large number of pores, the performance of a jet is not significantly degraded if a small number of pores are clogged by contaminants.

In a preferred embodiment, the inlet channel, filter, and other passages of the print head all have a vertical orientation that reduces the problem of bubbles being trapped by the filter and allows bubbles to be efficiently purged from the head, assisted by their natural buoyancy, with a minimum of wasted ink.

Additional objects, features and advantages of the present invention will be apparent from the following detailed description of a preferred embodiment thereof, which proceeds with reference to the accompanying drawings.

DETAILED DESCRIPTION OF PREFERRED EMBODIMENTS

Figure 1:
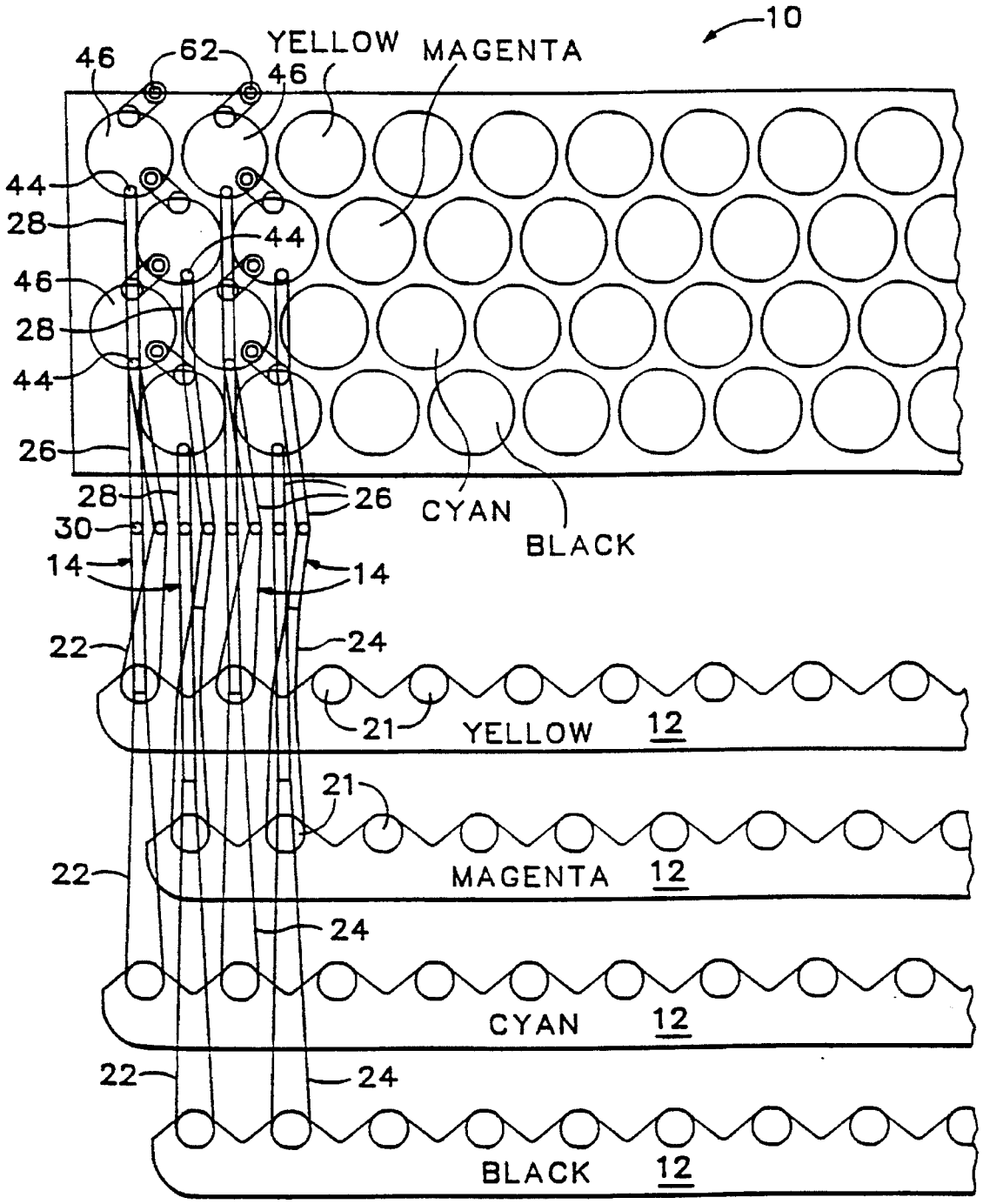
FIG. 1 is an enlarged, diagrammatic plan view of a portion of a preferred multiple jet print head, showing outlines of passages within eight of the jets.
Figure 2:
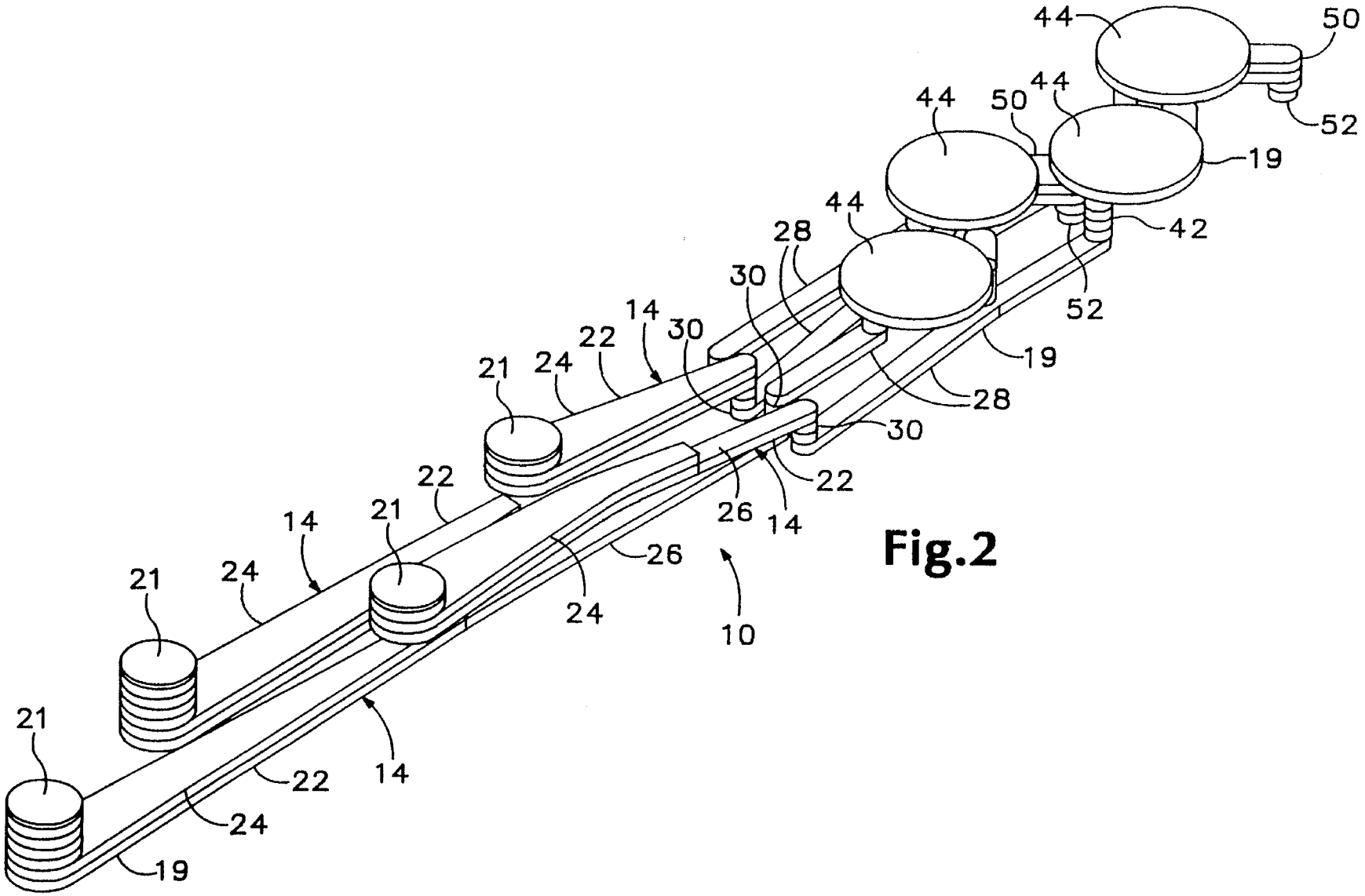
FIG. 2 is an enlarged, diagrammatic isometric view showing outlines of passages within four ink jets of the multiple jet print head of FIG. 1.

FIG. 1 shows a portion of a preferred multiple jet print head 10 having four supply manifolds 12, each supplying a different color of ink, typically yellow, magenta, cyan, and black, to multiple jets indicated generally by the reference number 14. FIG. 2 shows four jets from FIG. 1, each of jets 14 being supplied by different supply manifolds 12.

Figure 3:
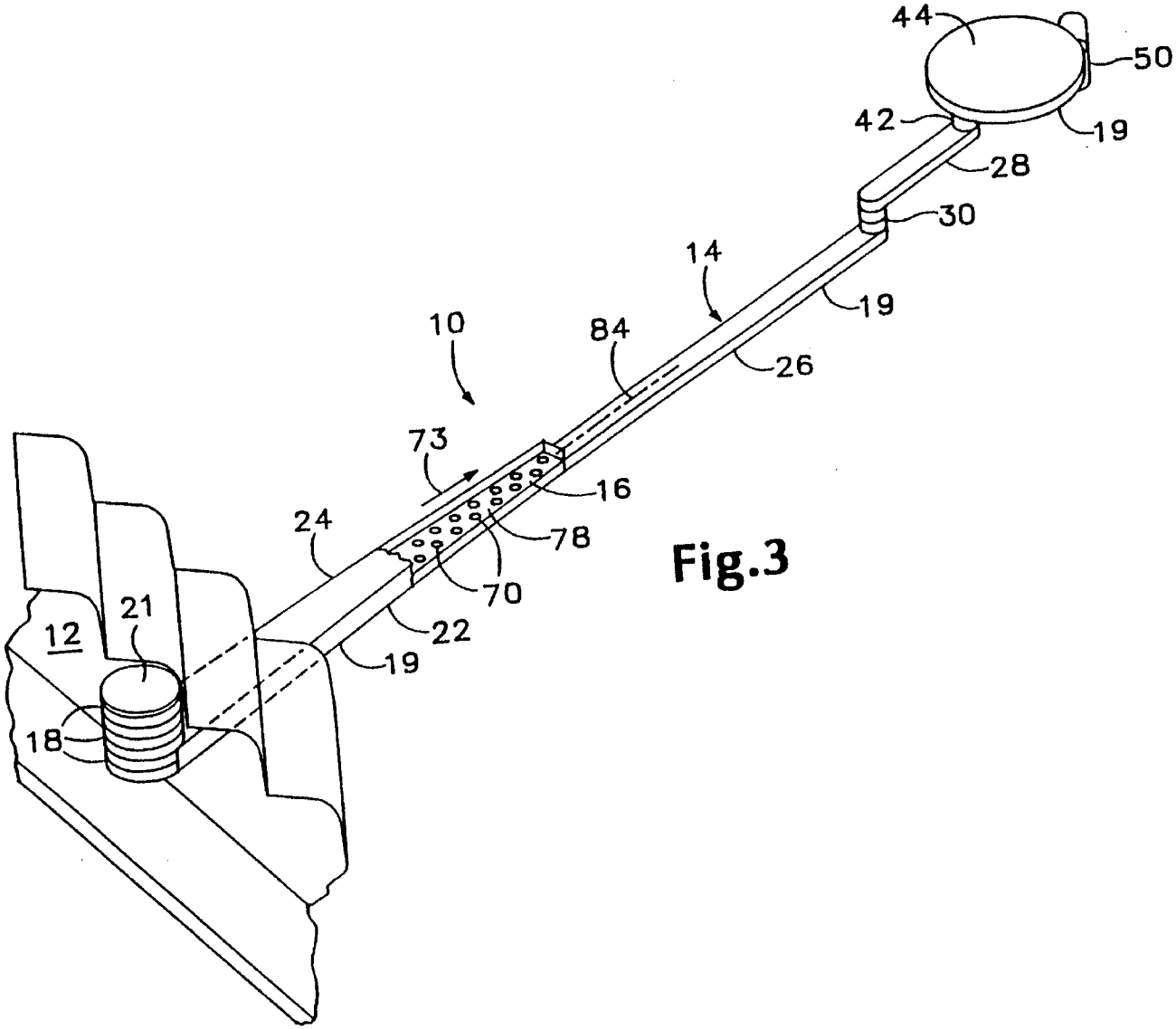
FIG. 3 is an enlarged, diagrammatic partly broken away isometric view showing a filter of the present invention within an outline of an individual ink jet of the print head of FIG. 1.
Figure 4:
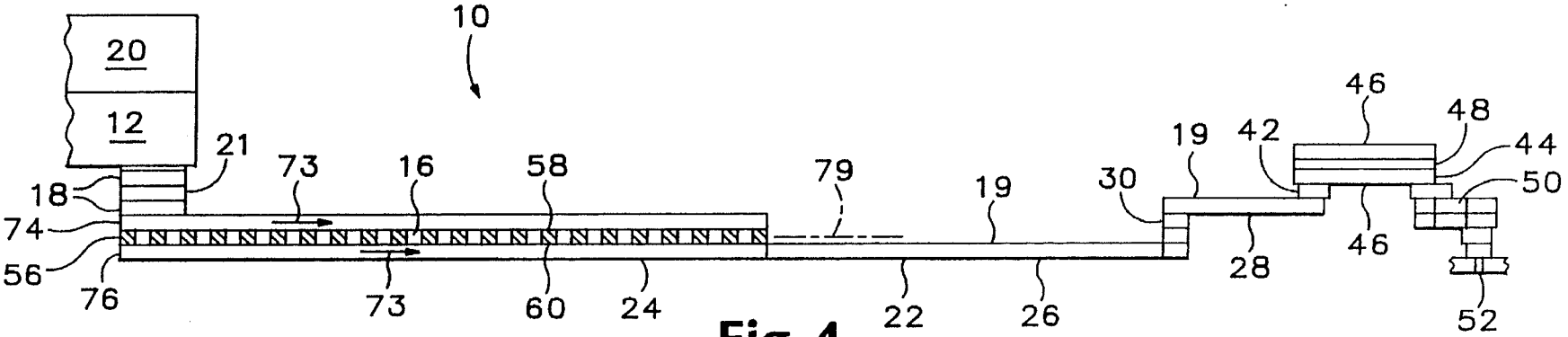
FIG. 4 is an enlarged, diagrammatic sectional view showing an outline of the ink jet of FIG. 3.
Figure 5:
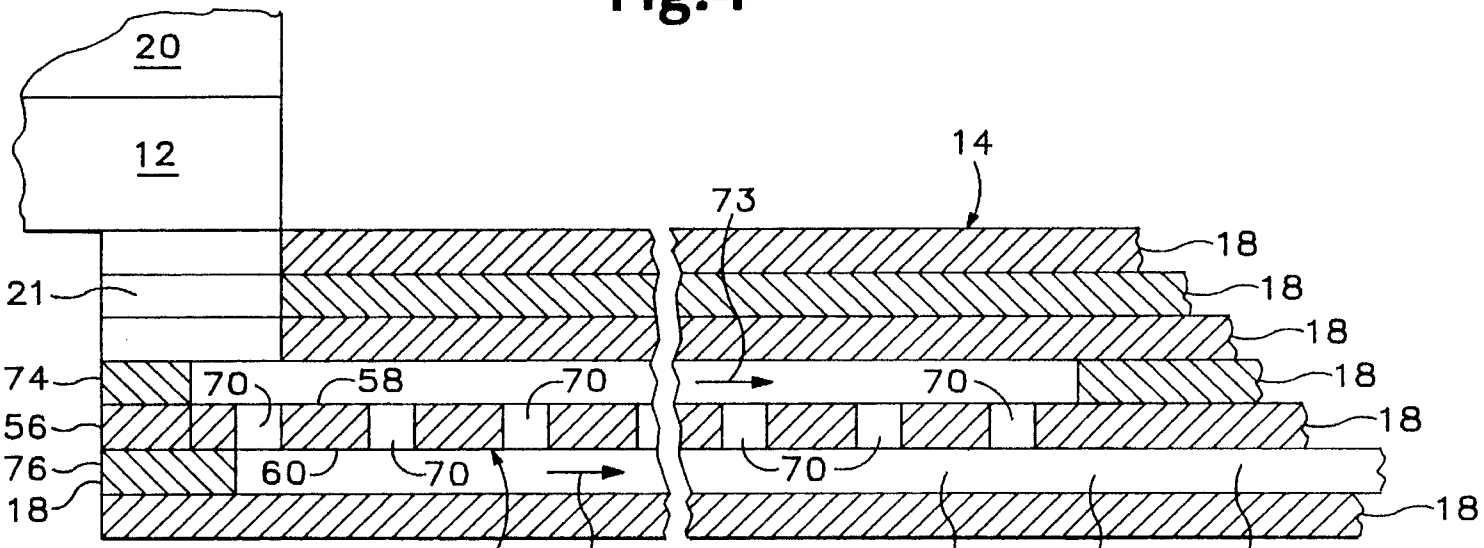
FIG. 5 is an enlarged sectional view showing the end nearest the manifold of the ink jet of FIG. 4.
Figure 6:
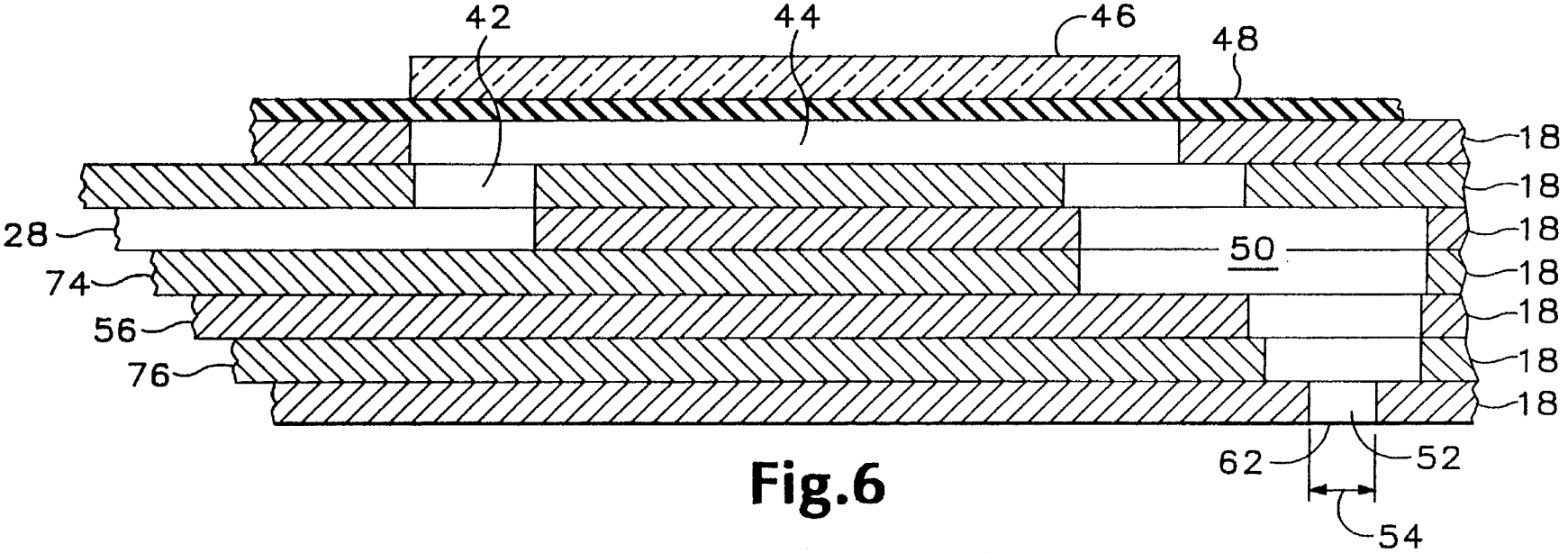
FIG. 6 is an enlarged sectional view showing the end nearest the nozzle of the ink jet of FIG. 4.

FIGS. 3 and 4 show different views of an individual jet 14. FIG. 3 shows an entire jet 14 with a section broken out to expose an inlet channel filter 16 of the present invention, and FIG. 4 shows an enlarged sectional view of filter 16 within the inlet channel. FIGS. 5 and 6 are sectional views showing opposing ends of jet 14.

FIGS. 5 and 6 show that print head 10 is typically constructed by laminating together various thin plates 18 composed of a material such as stainless steel which is rigid and does not react with ink. Each plate 18 includes holes or grooves so that when plates 18 are superimposed, the holes and grooves in individual plates 18 together define various inlets, outlets, chambers, and channels of print head 10, as well as filters 16 of the present invention. In FIGS. 1–3, the outlines or walls 19 of passages defined by holes or grooves in plates 18 are shown as solid lines to show more clearly the path of ink through jet 14. Plates 18 are typically bonded together by diffusion bonding and brazing.

Referring to FIGS. 3, 4, and 5, during operation of print head 10, ink flows from an external ink supply 20 to supply manifold 12 and then through an inlet port 21 into an inlet channel 22. Inlet channel 22 is typically composed of a tapered channel 24, an optional straight channel 26, and a final inlet channel 28. The final inlet channel 28 connects to tapered channel 24 or straight channel 26 via an inlet connection 30. Filter 16 is preferably located in tapered portion 24, although it could be located anywhere in inlet channel 22, including entirely within or extending into one or more of the plates 18 that are within inlet channel 22. The ink flows through filter 16 in tapered channel 24 and straight channel 26 and into final inlet channel 28.

FIG. 6 is a sectional view showing a portion of jet 14 downstream of final inlet channel 28. Referring to FIGS. 3, 4, and 6, the ink flows through final inlet channel 28 and pressure chamber inlet channel 42 to a pressure chamber 44. When a voltage is applied to a PZT 46 bonded to a diaphragm 48, diaphragm 48 bends into pressure chamber 44, thereby reducing the volume of pressure chamber 44 and forcing ink through a pressure chamber outlet channel 50 and out of a nozzle 52 onto a print medium such as paper (not shown). Nozzle 52 has a minimum nozzle opening diameter 54. The preferred range for nozzle opening diameter 54 is between 0.0015" (38 μm) and 0.0035" (89 μm) with a most preferred nozzle opening diameter 54 equal to approximately 0.0030" (75 μm) and, therefore, a nozzle area 62 of approximately $7.07\times10^{-6}$ in$^2$ (0.0044 mm$^2$). It will be apparent that the minimum nozzle opening diameter 54 and nozzle opening area 62 will vary considerably in different types of printers.

As is best seen in FIG. 5, filter 16 comprises a filter plate 56 having opposing planar, porous surfaces 58 and 60. Filter plate 56 has multiple filter pores 70, i.e., small holes in plate 56. Each pore 70 has a maximum pore size or diameter 72 (FIG. 7) somewhat smaller than minimum nozzle opening diameter 54, so most contaminants that could clog nozzle 52 are stopped before reaching it. The ratio of the maximum pore size 72 to the minimum nozzle diameter 54 has a preferred range of between about 0.1 and about 2.0, with a ratio of about 0.7 most preferred. A lower ratio provides better protection from particulate contamination, but requires a higher pressure difference across the filter to transport bubbles through the filter and a higher pressure during printer operation.

Because filter 16 is aligned generally along the direction of ink flow within inlet channel 22 as indicated by arrows 73 (see FIGS. 3–5 and 8), the total pore area, i.e., the combined area of all pores 70, is sufficiently greater than nozzle opening area 62 to ensure an adequate supply of ink to supply pressure chamber 44 while print head 10 is operating. Furthermore, because of the large number of pores 70, the performance of jet 14 is not significantly degraded if a small number of pores 70 become clogged by contaminants. Preferably the filter 16 has at least about 30 pores per nozzle opening. While a larger number of pores increases the tolerance to pore clogging, this must be balanced with the decreased pressure drop across the filter 16 that results during purging when clogging occurs and which affects bubble removal. Similarly, a preferred ratio of combined pore area to nozzle opening cross-sectional area 62 should be at least about twenty.

The filter 16 is sized so that changes in filter operation, such as holes or pores plugging, are insignificant in their impact on the effective fluidic inductance and fluidic resistance of the inlet channel 22. Filter 16 is designed so it contributes a small part, such as less than about 10% to the fluidic inductance and fluidic resistance of the ink jet. The design of filter 16 must be balanced so the resistance of the filter is not too great so that jet performance is affected and not so small that air bubbles won't be removed from the pores of the filter during purging. However, the filter 16 must still be sized with sufficiently small pores to trap contaminants. The design must avoid impacting the dynamic performance of the multiple jet print head 10.

To accomplish these results, the following equations and sample calculations were employed to optimize the design of the filter 16, using the following values:

Fluid Properties $\rho=0.85$ gm·cm$^{-3}$ $\mu=0.15$ poise $\alpha=100{,}000$ cm·sec$^{-1}$ Geometry $d_0=0.002$ in, where $d_0$ is the diameter of the filter hole;

$l_0=0.002$ in, where $l_0$ is the thickness of the filter;

A=0.04 in×0.016 in where A is an area equal to the width times the height of the filter, or A=0.004 cm$^2$;

Array Density (where the holes or pores are packed in a hexagonal configuration separated by a center-to-center distance L)—L=0.01 cm;

$$A_r=\frac{\pi\cdot d_o^2}{4L^2\cdot\sin(60°)},$$

where $A_r$ represents the total open area of the holes in the filter;

$$N_A=\frac{1}{L^2\cdot\sin(60°)},$$

where $N_A$ represents the number of holes per unit area, or $$N_A=1.119\times10^4\ \text{cm}^{-2};$$

$N=N_A\cdot A$, where N represents the total number of holes, or $$N=46.188;$$

Single Hole Resistance (R) and Inductance (L) Parameters $$R_o=\frac{128\mu\cdot l_o}{\pi\cdot\rho\cdot d_o^2},$$

where $R_0=5.485\times10^7$ cm$^{-1}$·sec$^{-1}$;

$$L_o=\frac{4l_o}{\pi\cdot d_o^2},$$

where $L_0=250.638$ cm$^{-1}$;

Array Resistance (R) and Inductance (L) Properties $$R_f=\frac{R_o}{N},$$

where $R_f=1.187\times10^6$ cm$^{-1}$·sec$^{-1}$; and $$L_f=\frac{L_o}{N},$$

where $L_f=5.426$ cm$^{-1}$.

Figure 7:
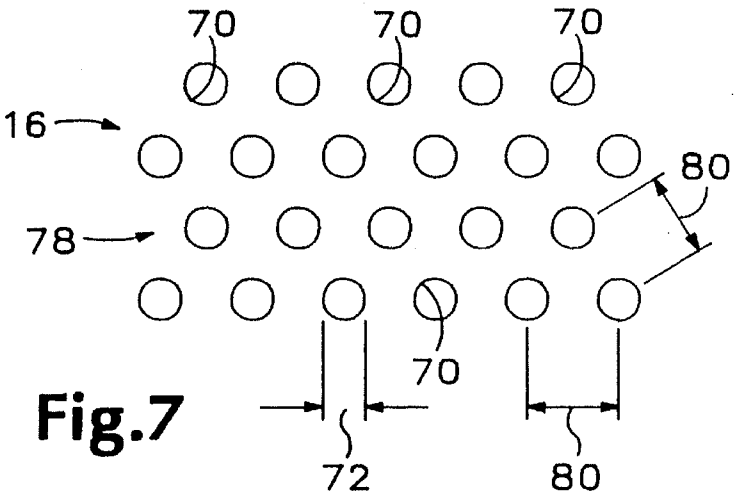
FIG. 7 is an enlarged plan view of a portion of the filter revealed in the broken away portion of FIG. 2.

A typical filter 16 is constructed from a stainless steel filter plate 56 having a thickness of approximately 0.002" (0.05 mm). Other suitable materials of construction can include aluminum, copper, nickel, and alloys thereof, although stainless steel is preferred. An appropriate non-shedding and heat resistant plastic material, such as Ultem® polyetherimide sold by the General Electric Company of Fairfield, Connecticut could also be employed. Filter plate 56 is photochemically milled using conventional processes to form a pattern similar to that of identical stainless steel inlet channel plates 74 and 76 that sandwich filter plate 56 and define tapered portion 24 of inlet channel 22. However, in place of the holes in inlet channel plates 74 and 76 that define inlet channels 22, filter plate 56 has hexagonal arrays 78 of pores 70 as shown in FIG. 7. Pores 70 could also be formed by other processes, such as punching, electric-discharge machining, electroforming, or through the use of a laser. Filter plate 56 preferably has the same thermal coefficient of expansion as the other plates comprising print head 10, so there is no distortion during the bonding process.

An important aspect of this invention is that the filter is aligned generally in the direction of ink flow so as to provide a relatively large filter surface area. Filter 16 is shown aligned parallel to inlet channel plates 74 and 76, but the plane of filter 16 could be tilted, i.e., the plane could intersect the plane of plates 74 and 76, without departing from the underlying principles of this invention. In other embodiments, filter 16 could be rotated along its longitudinal axis 79, or could be constructed from a form other than a plate, for example, a cylinder having surface pores. The filter 16 can generally be positioned parallel to the major axis of the inlet channel 22. Another important aspect of this invention is the placement of a filter, regardless of its configuration, close to the nozzle.

FIG. 7, an enlarged plan view of a portion of filter 16, shows that each of pores 70 has a diameter 72 which has a preferred range of between about 0.0002" (5 μm) and about 0.0060" (150 μm), with a range between about 0.001–0.002" (25–50 μm) being most preferred. Pores 70 are arranged in hexagonal array 78 with the centers of each pore spaced apart by a distance 80, which has a preferred range of between about 0.003" (75 μm) and about 0.008" (203 μm), with a range of between about 0.004 (100 μm) and about 0.006" (150 μm) being most preferred. Array 78 comprises approximately one hundred pores 70 over the area of tapered channel 24. The diameter 72, distance 80, and number of pores 70 will vary depending on the nozzle opening diameter 54 and the required ink flow rate within jet 14. A diameter 72 of about 0.002" (50 μm) provides adequate filtering and ink flow for a 70 μm nozzle 52. It will be apparent to skilled persons that the design of filter 16 will vary considerably in different print heads depending on print head design parameters, such as nozzle size, ink viscosity, and inlet passage configuration. For example, the shape, diameter 72, and spacing 80 of holes 70, as well as the geometry of array 78 may be changed without departing from the underlying principals of this invention.

Relating the ink flow to the filter design discussed above and that shown in FIGS. 5, 6, and 8, ink enters the tapered channel 24 of inlet channel 22 through inlet port 21 and flows in the channel defined by inlet channel plate 74. Ink passes through pores 70 in filter 16, flows in the portion of tapered channel 24 defined by inlet channel plate 76, and then into straight channel 26 or inlet connection 30.

Figures 8, 9A, 9B, 9C:
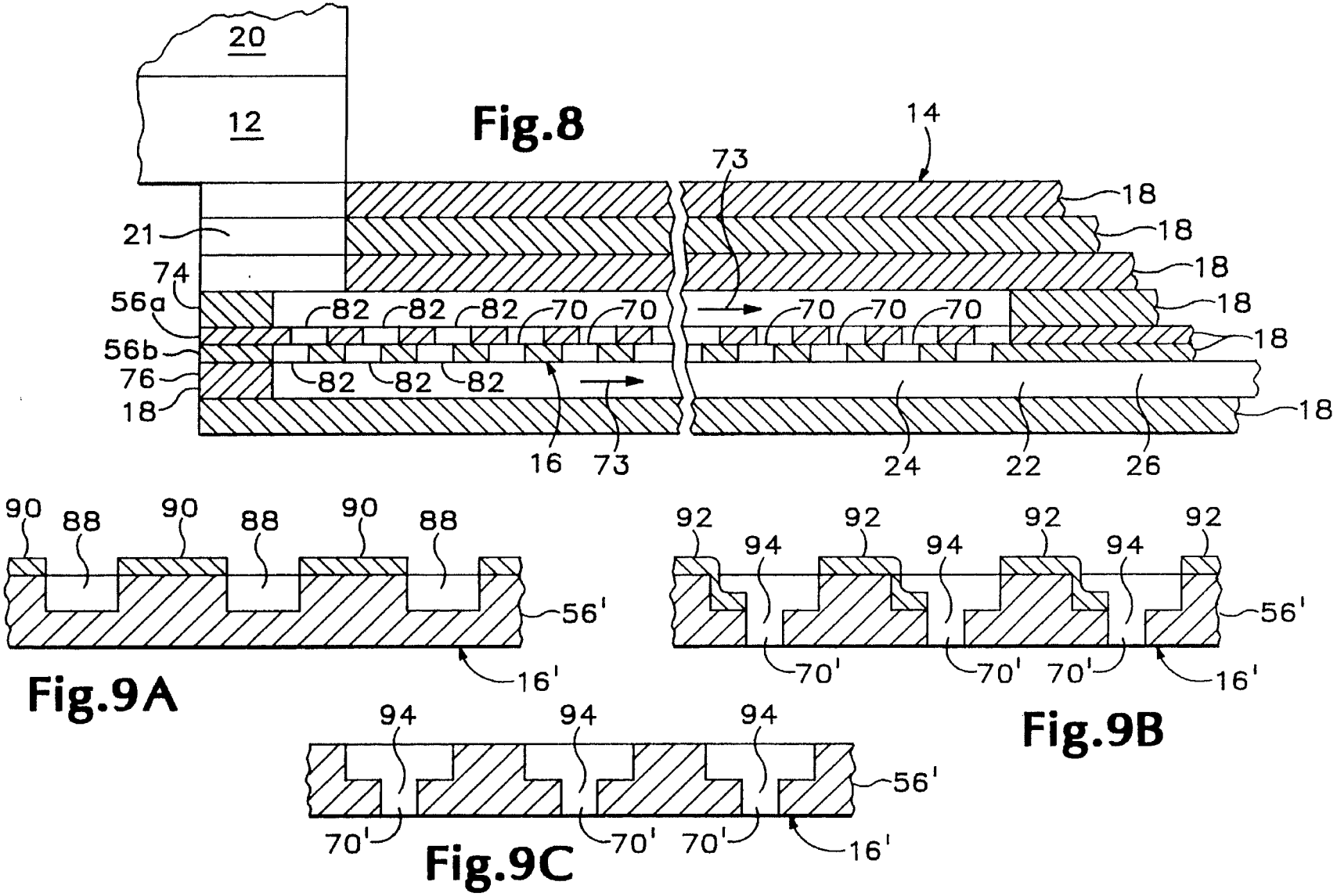
FIG. 8 is an enlarged sectional view showing the end nearest the manifold of an ink jet including an alternate embodiment of a filter of the present invention.
FIGS. 9A–9C show enlarged partial sectional views of different stages in the manufacturing of an alternate filter embodiment.

FIG. 8 shows an alternate embodiment in which filter 16 is constructed from two plates **56*a* and 56*b*, each plate having an array of holes 82 in the filter area with holes 82 of plate 56*a* offset with respect to the holes 82 of plate 56*b* so that the filter pore 70 is defined by the area of overlap of holes 82. Because such a filter pore 70 is smaller than the individual holes 82, this embodiment can be used to create filter pores 70 smaller than those that can be easily manufactured by conventional processes. However, such an embodiment requires tighter tolerances to be applied during the photochemical milling and bonding operations so that the total error is less than approximately one half of the maximum pore diameter diameter 72**.

A filter 16' having pores 70' smaller than those that can be fabricated using conventional photochemical machining could also be created on a single filter plate 56' by using a two step photochemical milling process, as shown in FIGS. 9A–9C. FIG. 9A shows that in the first step holes 88 are etched partly into filter plate 56' in areas not protected by a first layer of photoresist 90. FIG. 9B shows that in the second step, photoresist layer 90 is replaced with a second photoresist layer 92 having a hole pattern similar to that of photoresist layer 90, but offset thereto. Filter plate 56' is then etched through second photoresist layer 92 until areas 94 that were etched during both steps are etched completely through filter plate 56', to form pores 70'. Only areas 94 defined by the overlap of the hole patterns in photoresist layers 90 and 92 are etched completely through filter plate 56' The pores 70', defined by areas 94, can be made smaller than hole filter pores 70 produced by a single step chemical milling process. The shape, size, and offset of the holes on photoresist layers 90 and 92 can vary to produce filter pores 70' for diverse applications.

Print head 10 is preferably mounted within a printer so that a longitudinal axis 79 of jet 14 is aligned substantially vertically and ink, therefore, flows in a horizontal direction through filter 16. The vertical orientation reduces the number of bubbles trapped by the filter. Entrapped bubbles are more easily removed in the vertically oriented print head because the buoyancy of the bubbles assists purging. Furthermore, bubbles are more effectively purged from filter 16 in inlet channel 22 than from a filter in or before manifold 12 because the pressure drop across a filter in inlet channel 22 is greater than that across a similar filter in manifold 12.

Print head 10 is designed so that plate-to-plate alignment is not critical because the tolerances typically held in a photochemical machining process are adequate. Various plates 18 forming ink jet print head 10 of the present invention may be aligned and bonded in any suitable manner, including the use of suitable mechanical fasteners.

A preferred approach for bonding suitable metal plates 18 is described in U.S. Pat. No. 4,883,219 to Anderson et al. for the Manufacture of Ink Jet Print Heads by Diffusion Bonding and Brazing, which is assigned to the assignee of the present application and is hereby incorporated by reference in its entirety. This bonding process is hermetic, produces high strength bonds between the parts, leaves no visible fillets to plug the small channels in print head 10, does not distort the features of print head 10, and yields an extremely high percentage of satisfactory print heads 10. Furthermore, the high temperatures used in the bonding process help to eliminate organic particulate contamination inadvertently included within the stack of plates during bonding. Therefore, a filter of the present invention that is fabricated from a plate or plates within the stack produces a particulate free zone from the filter to the nozzle. The filter of the present invention will then trap any particulate contamination introduced during assembly after the bonding process. This manufacturing process can be implemented with standard plating equipment, standard furnaces, and simple diffusion bonding fixtures. The process can take fewer than three hours from start to finish for the complete bonding cycle, while many ink jet print heads 10 are simultaneously manufactured.

A plurality of drive signal sources (not shown) drive multiple associated PZT's 46, causing ink to be drawn from manifold 12 through inlet port 21, inlet channel 22, inlet connection 30, pressure chamber inlet channel 42 into ink pressure chamber 44, and then through pressure chamber outlet channel 50 and out of nozzle 52. The flow rate of the ink at various locations within jet 14 depends on the electrical drive waveform with which the drive signal source separately drives each PZT 46. The drive signal source can provide to each PZT 46 substantially identical drive waveforms to effect equal jetting characteristics for each separate nozzle 46. Although individual features within different jets 14 may vary, the equal jetting characteristics stem from the acoustically equivalent design of the combination of features of each individual jet 14, as described in the aforementioned and incorporated by reference U.S. Pat. No. 5,087,930.

Although multiple ink jets 14 are supplied with ink from each manifold 12, acoustic isolation among the ink jets 14 coupled to a common manifold 12 is achieved because manifolds 12 and the passages between manifolds 12 and pressure chamber 44 function as acoustic resistance-capacitance circuits that dampen pressure pulses. Filter 16 within the inlet channel 22 contributes to the damping of the pressure pulses by acting as an additional acoustical wave filter. These pressure pulses could travel back through inlet channel 22 from the pressure chamber 44 in which they were originated, pass into common manifold 12, and then into adjacent inlet channels 22 to adversely affect the performance of adjacent jets 14.

It is anticipated that filter 16 could be used as one stage in a series of filters. For example, filters may also be placed within manifold 12 or between manifold 12 and an ink reservoir (not shown). A filter could also be placed in the inlet channel 50, intermediate the pressure chamber 44 and the nozzle 52.

It will be obvious to those having skill in the art that many changes may be made to the details of the above-described embodiment of this invention without departing from the underlying principles thereof. Accordingly, it will be appreciated that this invention is also applicable to applications other than those found in drop-on-demand ink jet recording and printing. The scope of the present invention should, therefore, be determined only by the following claims.

We claim:

1. An ink jet print head having improved particulate filtering and bubble purgability, comprising:

a nozzle having a nozzle diameter ranging from about 0.0015 inches to about 0.0035 inches for ejecting ink onto a print medium, the nozzle further having an inlet side for receiving ink and an outlet side from which the ink is ejected;

an ink supply manifold connected to the nozzle;

an elongated inlet channel having a longitudinal axis, the inlet channel connecting the ink supply manifold and the nozzle such that there is only one inlet channel per nozzle, the inlet channel having an interior that provides an ink flow path between the ink supply manifold and the nozzle;

a pressure chamber in the print head in flow communication with the nozzle such that there is only one pressure chamber per nozzle, the pressure chamber causing ink to eject from the outlet side of the nozzle; and a particulate removing filter having a major axis positioned within the interior of the elongated inlet channel and oriented substantially parallel to the longitudinal axis, the particulate removing filter having multiple pores each having a pore diameter ranging from about 0.0002 inches to about 0.006 inches and a pore axis oriented substantially transverse to the major axis, the pores taken together having a total pore area and the nozzle having a nozzle opening area such that a ratio of the total pore area to the nozzle opening area is sufficiently large to provide an adequate supply of ink to the nozzle during operation of the print head and is sufficiently small to provide a pressure drop across the filter that is adequate to draw bubbles through the filter during purging of the print head.

2. The print head of claim 1 in which the ratio of the total pore area to the nozzle opening area is greater than about 20.

3. The print head of claim 1 in which the major axis of the particulate removing filter has a non-horizontal orientation.

4. The print head of claim 3 in which the major axis of the particulate removing filter has a substantially vertical orientation.

5. The print head of claim 1 in which multiple nozzles are supplied with ink by separate inlet channels, each of the inlet channels having a particulate removing filter positioned therein.

6. The print head of claim 1 in which the pore diameter is less than about 0.002 inches and the nozzle diameter is greater than about 0.002 inches.

7. The print head of claim 1 in which the particulate removing filter comprises plural laminated plates.

8. The print head of claim 7 in which the plural laminated plates are formed from a material selected from a group consisting of stainless steel, aluminum, copper, nickel, and polyetherimide.

9. The print head of claim 1 in which the particulate removing filter is formed by a method, comprising the steps of:

providing a filter plate having first and second sides;

forming a hole pattern partly through the first side of the filter plate; and forming a second hole pattern partly through the second side of the filter plate, the second hole pattern having holes offset with respect to those of the first hole pattern, whereby the area of overlap of the hole patterns forms pores in the filter plate smaller than the holes of either hole pattern.

10. The print head of claim 9 in which the forming of the first and second hole patterns is accomplished by one technique selected from the group consisting of photochemically machining, punching, electric-discharge machining, electroforming and laser forming.

11. The print head of claim 1 in which the print head further has a total fluidic resistance and fluidic inductance, and in which the filter has a filter fluidic resistance and fluidic inductance that is less than about 10% of the total fluidic resistance and fluidic inductance.

* * * * *